US007399507B2

(12) United States Patent
Bhatt et al.

(10) Patent No.: US 7,399,507 B2
(45) Date of Patent: Jul. 15, 2008

(54) METHOD FOR PREPARATION OF A LITHOGRAPHIC PRINTING PLATE AND TO A LITHOGRAPHIC PRINTING PLATE PRODUCED BY THE METHOD

(76) Inventors: Jivan Gulabrai Bhatt, 301, Girijashankar, 12th Cross Road, Malleswaram, Bangalore 560 003, Karnataka (IN); Thyagarajan Anantharaman Iyer, 202, Suparshay Apartments, Sarvodaya Nagar, Mulund (W), Mumbai 400080, Maharashtra (IN)

( * ) Notice: Subject to any disclaimer, the term of this patent is extended or adjusted under 35 U.S.C. 154(b) by 108 days.

(21) Appl. No.: 10/769,609

(22) Filed: Jan. 30, 2004

(65) Prior Publication Data

US 2005/0266348 A1 Dec. 1, 2005

(30) Foreign Application Priority Data

Feb. 3, 2003 (IN) ..... 141/MUM/2003

(51) Int. Cl.
*B05D 5/06* (2006.01)
*H05H 1/00* (2006.01)

(52) U.S. Cl. ..... 428/32.26; 428/32.28; 428/32.7; 427/316; 427/533; 430/271.1

(58) Field of Classification Search ..... 430/270.1, 430/271.1, 281.1, 302; 428/32.26, 32.37, 428/32.28, 32.7; 427/316, 533
See application file for complete search history.

(56) References Cited

U.S. PATENT DOCUMENTS 3,850,672 A * 11/1974 Tani et al. ..... 428/220
6,083,658 A * 7/2000 Kunita et al. ..... 430/270.1
6,245,421 B1 * 6/2001 Aurenty et al. ..... 428/304.4
6,383,729 B1 * 5/2002 Ohnuma et al. ..... 430/533
6,440,532 B1 * 8/2002 Ogawa et al. ..... 428/141
6,485,812 B1 * 11/2002 Sekiguchi ..... 428/32.29
6,548,232 B2 * 4/2003 Goto ..... 430/350
6,677,005 B2 * 1/2004 Kaneko et al. ..... 428/32.25
6,846,526 B2 * 1/2005 Bermel et al. ..... 428/32.26
2005/0118543 A1 * 6/2005 Ezure ..... 430/619

FOREIGN PATENT DOCUMENTS

EP 1 095 784 A2 * 5/2001
JP 10-010676 * 1/1998

* cited by examiner

*Primary Examiner*—Richard L. Schilling
(74) *Attorney, Agent, or Firm*—Bromberg & Sunstein LLP

(57) ABSTRACT

A method of preparation of a Lithographic Printing Plate comprising the steps of, selecting a substrate for making of the printing plate from a natural or synthetic polymeric sheet element material having a tensile strength in the range of 400 to 3000 Kgm/cm2 and thickness ranging from 75 microns to 250 microns; shrinking the said substrate to have shrinkage in the range of 0.2 to 2.0% by exposing the substrate to heat of temperatures ranging from 140 to 180 degrees Celsius for 8 to 12 minutes; subbing the substrate to alter the surface energy of the substrate; forming a hydrophilic lithographic coating by reacting a hydrophilic binder with a cross linking agent, an accelerator, at least one pigment, at least one cationic surfactant and particulate silica having micron size ranging between 1 to 5 microns and a pore volume ranging between 0.2 ml/gm to 1.8 ml/gm wherein the ratio of the catalyst to accelerator to cross linking agent to binder to pigment to anionic surfactant to particulate silica is 1:2 to 1:2 to 2:1 to 20:25 to 60:80 parts and applying at least one ply of the hydrophilic lithographic coating on the subbed substrate.

21 Claims, No Drawings

METHOD FOR PREPARATION OF A LITHOGRAPHIC PRINTING PLATE AND TO A LITHOGRAPHIC PRINTING PLATE PRODUCED BY THE METHOD

This invention relates to a method for preparation of a Lithographic Printing Plate and to a Lithographic Printing Plate produced by the method.

The product can also be described using the following terms: Direct-to-Plate Inkjet Lithographic Printing Plate, Computer-to-Plate or CtP Inkjet Lithographic Plate, Computer-to-Poly or CtPoly Inkjet Lithographic Plate). The plate consists of a flexible hydrophilic substrate that is imaged using inkjet printers/plotters for use as a printing plate on an offset printing press.

In particular, this invention relates to a method of preparing a lithographic printing plate for use by means of Inkjet imaging on a substrate, particularly flexible hydrophilic substrate.

In accordance with another aspect of this invention, it further relates to a method for enhancing the print run length (i.e. the number of copies or impressions that can be printed from the imaged plate) of the said plate through a process of fixation.

Traditional methods of printing include letterpress printing, gravure printing, offset lithographic printing, and screen-printing. In recent times, with computerization and digitalization of graphic design, photography, page compositions and image transfer processes; digital printing has made rapid strides in the developed nations.

All printing processes utilize image carriers to print images on substrates such as paper, plastics, metal, etc. Various types of flexible metal, plastic or paper printing plates serve as image carriers in the offset printing process.

The method of creating images on the printing plates has been a subject of considerable research spanning over several decades. Technologies have evolved from manual etchings & engravings to photo-mechanical imaging using ultra-violet light to digital imaging using green, blue, red, infrared & violet lasers.

Each printing process has its own typical requirements with regard to the image forming areas of the printing plate. With the gravure process, the image areas are recessed; with letterpress, the image areas are in relief or raised above the non-image or background areas; with screen printing, the image areas are etched out to allow the ink to pass through; offset is the only process where the image and non-image areas are on the same plane or surface.

The offset plate, therefore, requires special manufacturing as well imaging process to impart oleophilic (ink loving) properties to the image areas, which have to be printed, and hydrophilic (water loving) properties to the non-image or non-printing areas. The substrate used for manufacture of offset printing plates consists of metals, aluminum being the most popular, or plastic (polyester being the preferred choice).

Offset printing plates can be grouped into the following categories:

First generation offset plates consist of grained and anodized aluminum plates. These require extended plate preparation time and complicated processing steps to be carried out by the end-user: whirled coating of a photo-sensitive layer; exposure through a film negative or positive; acid development; solvent-based etching; stencil removal, desensitization, gumming up, inking up, etc. The total time to process such a plate is approx. 90 minutes, and the print results are inconsistent and lack sharpness.

The second generation offset plates, known as presensitized plates, consist of grained and anodized aluminum plates pre-coated with photosensitive diazo or photo-polymer coatings that are either positive working or negative working. Presensitised plates have a shorter processing cycle of approx. 5 to 10 minutes per plate consisting of exposure to UV light through a film negative or positive, removal of the coating in non-image area using suitable developers in an automatic processor or manually, and wiping the plate surface manually or in an automatic processor with a protective film of gum. These plates are supplied in pre-coated form by the manufacturer and have to be handled extremely carefully during transport, storage and handling by the end user, as they are extremely sensitive to daylight, heat and moisture.

As mentioned, presensitised plates require the use of an intermediate film positive or negative to serve as a mask at the time of exposure. In a positive plate, the film positive blocks the UV light from exposing the coating in the image areas, whereas it renders the coating in the non-image areas soluble through light reaction and dissolves away during the wet development process. In a negative plate, the film negative allows the light to expose the image areas and renders them insoluble in the developer; therefore, they remain on the plate after wet development while the original unexposed coating is removed from the non-image areas. The time for preparation of the film positive/negative and the costs involved, are the main limitations of the presensitised plate.

A third generation offset plates, known as digital plates, consist of grained and anodized aluminum coated with coating that are specially formulated to be reactive to different types of lasers. With the advent of digital technology, original pictures and words are now created or converted into digital formats in a computer. These digital images are then transferred from the computer in the desired format and page composition to a laser-imaging device known as the Platesetter or CtP (Computer-to-Plate) imgalng device. The digital page is then exposed directly on to the digital plate in the Platesetter. The Plate is then developed in a processor to remove the non-image areas, followed by application of a protective film of specially formulated gum. The total processing time per plate is similar to presensitised plates, but the time & costs involved for preparation of the intermediate film positive/negatives are eliminated.

Three types of digital offset plates are currently offered:

A. Thermal Plates that are sensitive to heat & imaged using infrared lasers (830 or 1064 nanometers).

B. Silver-sensitized Plates that are exposed using violet (410 nm), or green (YAG 532nm), or red (HeNe 670nm) lasers.

C. Photopolymer Plates that are exposed using violet (410 nm) or blue (argon 488nm) or green (YAG 532nm) or red (HeNe 670nm) lasers.

All the digital plates mentioned above require/very expensive and unwieldy laser Platesetters and involve chemical processing, with some of the chemicals requiring conformity with stringent disposal norms. In addition, the plates are very expensive. Consequently, the advantages of speed and the savings of film intermediates are nullified by the additional costs. Therefore, Digital Plates have not met with universal acceptability and their use is limited currently to the high-end newspapers & commercial printers where speed is of essence.

To overcome some of the limitations of the above-mentioned varieties of digital plates, the applicant introduced an affordable, simple and safe digital offset plate "NovaDom*" Polyester Laser Plate (*trademark of the applicant). This plate is made from polyester (polyethylene terephthalate—Also known as PET) base and is imaged directly on a toner-based laser printer. It does not require the use of any chemicals for processing after imaging, and can go directly to an offset press for printing approx. 20,000 copies from each side of the plate. Each side of the plate consists of specially coated surface, which is hydrophiuic, and yet capable of establishing a durable bond with the toner deposited in the image areas by a laser printer. The image formed by the laser printer toner acts as the Oleophillic receiver, and picks up ink on the press for transfer to the offset blanket and then on to the paper or other printing substrate.

NovaDom Polyester Laser plate has proved to be one of the most popular digital printing plates for small format single and spot color printing, worldwide. NovaDom plate won the world's most prestigious award viz. The InterTech Technology award from GATF (Graphic Arts Technical Foundation), USA in 1995, for being "a unique innovation that will impact the future of the printing industry" (in the words of the Judging Committee). (GATF is the world's largest independent, industry run, research organization for the printing & allied industries. Its annual awards for product innovations are the industry equivalent of the Nobel Prize. Past winners consist essentially of global conglomerates, and the applicant is the only winner from outside of the North America, UK, North Europe and Japan since the inception of the Awards 20 years ago,)

NovaDom, and other brands of polyester laser plates that followed, suffer from the limitation of inherent in a laser printer viz. the maximum plate size that can be accommodated on the current generation of laser printers is A3. The image resolution and registration accuracy is also limited by the capability of the laser engines, thereby rendering this plate unsuitable for high quality four-color process printing.

This invention overcomes the limitations of NovaDom and other Polyester Laser Plates, by providing a method of making and imaging a plate that is suitable for imaging on standard large-format inkjet printers using standard inks such as HP 51645A, HP 51640A, and HP 51629A of Hewlett Packard; Epson T 5431 Photo Black, Epson T480011Black; Epson T5437 Light Black; Epson T5432 Cyan, Epson T483011 Cyan; Epson T5434 Yellow, Epson T481011 Yellow; Epson T5435 Light Cyan, Epson T485011 Light Cyan; Epson 15436 Light Magenta, Epson T484011 Light Magenta. The aforesaid is an illustrative list of inks, not meant to be exhaustive.

This invention also seeks to provide a Hydrophilic substrate according to invention, that can be imaged using standard commercially available inks on a range of inkjet printers using piezo, thermal, bubble jet or continuous ink jet technology.

In recent years, inkjet printers have replaced laser printers as the most popular output device for graphic printing. The advent of these printers have made it possible to output in sizes ranging from A8 to super-wide format printing. These printers are of low cost and their reliability has improved significantly in recent times. The resolution capabilities have greatly enhanced, e.g. Epson 7600 is capable of delivering resolution of up to 2400 dpi.

Various disclosures haste been made of the use of inkjet systems for creating an image on grained & anodized aluminum printing plates and other hydrophilic lithographic surfaces. All of these methods and claims pertain to use of specific oleophilizing compounds used as the imaging medium in either liquid or semi-solid (wax) form in the printer's ink cartridge, in place of the standard inkjet printing ink.

In one such disclosure U.S. Pat. No. 5,501,150 [no Indian equivalent] a fluid ink and hydrophilic media set containing materials to produce a silver reducible image by inkjet printing, is used to make a metallic silver image. Major disadvantages are the complexity of the imaging fluid and the need to wet process the silver image to make it sufficiently hydrophobic.

In another such disclosure wherein the ink is a solid or phase change type ink as per U.S. Pat. No. 4,833,486 [no Indian equivalent] to deposit hot wax on to surface of an offset plate is described. The roundness of the solidified droplet does not have the resolution of the liquid inkjet.

U.S. Pat. No. 5,511,477 [no Indian equivalent] discloses a method for producing a photo, polymeric relief type printing plates using a photo polymeric ink composition suitable for forming a negative or positive image.

U.S. Pat. No. 5,312,654 [no Indian equivalent] also discloses a method for making lithographic printing plate using photo polymerisable ink composition on a hydrophilized ink composition. The said image is sensitized to cure the image by exposure to actinic light.

Research disclosure 289118 [no Indian equivalent] discloses a method for making printing by means of an inkjet wherein the ink is hydrophobic polymer latex.

The critical aspect of disclosures mentioned above, and other methods published, necessitate the need for specially formulated compounds to serve as imaging inks. None of them claim to work with standard commercially available inkjet printing inks supplied by the manufacturers of inkjet printers. Also, none of them claim original work done to produce a lithographic plate that can be imaged satisfactorily on inkjet printers and other non-impact and mechanical printer using standard commercially available inks. The plate made as per our invention can be imaged on standard inkjet printers using standard inkjet inks as mentioned above. In addition, the plate can also be imaged on other non-impact printers such as laser printer, etc. as well as impact devices such as photocopier, dot-matrix printer, etc.

Use of specially formulated imaging fluids & compounds referred to in the disclosures mentioned above, create considerable technical & practical usage problems with regard to filling into, and compatibility with, the inkjet cartridges required to be used on inkjet printers. Many of the inkjet printers come with proprietary cartridges and proprietary inks, and contain proprietary microchips, which control the level of ink and respond to the print head. The printers are also able to identify whether the cartridge is genuine. It is not feasible to fill specially formulated imaging fluids in these cartridges, as the guarantee on the performance of the printer becomes void if the original cartridge & ink combination not used. Also, there are other potential complications such as to damage to print heads and ink conduit lines. Moreover, cartridges supplied by the proprietary imaging fluid manufacturers filled with their own imaging fluids, cannot be used on printers as they do not contain the printer manufacturer's microchips. What is clearly unique about the Plate under this invention is that it does not require the use of specially formulated imaging fluids and instead, works with the standard inkjet cartridges & inks supplied by printer manufacturers.

Unlike the plate under this invention, none of the disclosures referred to above claim compatibility with non-impact digital printing devices (e.g. laser printer), nor do they claim compatibility with impact printers (e.g. dot-matrix printer) and manual imaging methods (e.g. calligraphy).

Some patent disclosures mention presensitised metal plates (i.e. metal plates that are grained, anodized and coated with photosensitive coating) that are imaged on inkjet printers using special inks or fluids. These plates have not found commercial acceptability, as they are not flexible enough to be transported easily through inkjet printers and create difficulties especially where the transport path is not straight.

Importantly, this methodology also suffers from the problems referred to the above viz. Rejection by the inkjet printers of non-proprietary ink cartridges filled with imaging fluids. Also, none of these patent disclosures claim compatibility with all types of inkjet printing devices as well as other non-impact printers (such as laser printers) and impact printers (such as dot-matrix printers) and manual imaging (such as calligraphy).

The plate under the present invention is compatible with non-impact printers (inkjet as well as laser printers), non-impact printers (including dot-matrix printers), and manual imaging methods (including calligraphy). The plate under this invention is made from a flexible plastic material, and is compatible with standard inkjet inks and cartridges.

The Plate under the present invention is compatible with non-impact printers (inkjet as well as laser printers), non-impact printers (including dot-matrix printers), and manual imaging methods (including calligraphy). The Plate under this invention is made from a flexible plastic material, and is compatible with standard inkjet inks and cartridges.

The said invention also pertains to the development of an ink receptive substrate, wherein a reverse printing of up to 6 points is possible.

This invention, therefore, extends the boundaries of the currently available technology as well as the applicant's own polyester laser plates.

The uniqueness of this invention is the development of a flexible polyester-based plate that can be imaged with the recommended standard commercially available inkjet inks on standard commercially available inkjet printers, without the need to wet process the plate after imaging, and having the capability to print high-resolution four color process work. This polyester inkjet plate can also be imaged on other non-impact and impact-printing devices such as laser printers, photocopiers, dot matrix printers, and typewriter using oil based ribbons, thermal printers. The quality of the images would depend upon the capability of the imaging device. The print capability of the plate on an offset press would remain more or less unchanged; with the print run length dependent on the imaging device and the press settings. Experiments conducted indicate run length varying from 20,000 copies from each side when imaged using an Epson inkjet printer to 5,000 copies using a laser printer or photocopier.

Another unique feature is that this plate can also be imaged using manual methods such as writing on the plate using calligraphic pens and lithographic inks. Hand-written additions, including signatures, etc can also be incorporated using special addition pens filled with oleophilic inks.

This plate is also unique as it can be coated with conventional wipe-on diazo coating. These diazo coatings can be wiped on the plate surface by hand, and exposed to an ultraviolet light source through a film negative. Thereafter, it can be processed in the normal manner using the standard wipe-on lacquer developer. The print quality of the plate would be similar to conventional plates.

This invention also pertains to the development of an ink receptive substrate, wherein a 2% dots could be effectively reproduced, with instant drying, no smudging, no background scumming, dot gain as per industry standards, and print resolutions matching commercial printing requirements.

When used with inkjet printers, this plate is unique as it uses standard inks, which result in low costs and easy integration of the plate imaging process into the normal workflow used in offices, print shops and publishers.

This plate is also unique as it does not suffer from size limitations of polyesters laser plates since inkjet printers are available in large format (width of 60" and more).

The plate is uniquely capable of very high resolution including stochastic screens (frequency modulated screens) used for reproducing high quality multi color photo realistic images.

Another unique and useful feature is that the same inkjet printer that is used for imaging this plate can also be used for digital color proofing of a four color print job. This ensures a very close match between the color proof and the final printed result obtainable from the printing plates imaged on the same printer. Large format inkjet printers are used extensively in printing and newspaper establishments for proofing. This polyester inkjet plate would integrate seamlessly into their current workflow.

It is also an object of the present invention to provide a simple and inexpensive method for preparation of a Direct-to-Print printing plate An object of the present invention is to provide a method to make plates for use with commercially available inks and development of a hydrophilic substrate to suit the commercially available inks for inkjet printing, such as Ink HP 51645A, HP 51640A, and HP 51629A of Hewlett Packard. Ink Epson T 5431 photo black, Epson T480011Black. Ink Epson T 5437 Light Black. Ink EpsonT 5432 Cyan, Epson T 483011 Cyan. Epson Ink T 5434 Yellow, Epson T 481011 Yellow. Epson Ink T 5435 Light Cyan, Epson T 485011 Light Cyan. Epson Ink T 5436 Light Magenta, Epson 484011 Light Magenta and the like.

Another object of this invention is to reproduce image imaged through any and all inks, which are pigment-based inks in the market and the upgrades.

Another object of this invention is the development of the ink receptive substrate, wherein a 2% dots could be effectively reproduced.

A further object of the invention is the development of an ink receptive substrate, wherein a reverse printing of up to 6 points is achieved.

Still another object of this invention is to provide a lithographic plate that is able to receive information thereon for the purposes of reproduction from any output device including a typewriter, a cyclostyling apparatus, a dot matrix printer, an inkjet printer or a laser printer or even by manual application of the matter to be reproduced.

Yet another object of this invention pertains to development of a hydrophilic substrate, which can also be imaged through a laser printer for preparation of a lithographic printing plate.

The invention provides compatibility to reproduce image imaged through any and all inks, which are pigment-based inks in the market and the upgrades. When used with inkjet printers, this plate offers several unique advantages:

The invention provides compatibility to reproduce image imaged through any and all inks, which are pigment-based inks in the market and the upgrades. Standard inks can be used. Therefore, costs would be low and the plate imaging process would integrate into the normal workflow-used in offices, print shops and publishers.

It is an object of this invention to provide a plate, which is compatible for use with conventional diazo, photo polymer and thermal plate coatings. A further objective is the development of a hydrophilic substrate as per invention, which can be imaged through a thermal transfer process with a thermal ribbon for preparation of a lithographic printing plate. Yet another objective is the development of a hydrophilic substrate, which can be imaged through calligraphy using special inks for preparation of a lithographic printing plate, or via a typewriter with oil based ink ribbons for preparation of lithographic printing plate.

Typically, in accordance with this invention the hydrophilic substrate can be treated using a photochemical method with a photosensitive coating. This when used with a image stencil for masking could on exposure to actinic light form an image which could be used as a lithographic printing plate. The said photo sensitive coating could be positive or a negative working polymeric system.

Further, the unique coating designed with an ink receptive layer, could be a universal imaging base for preparation of a lithographic printing plate.

According to this invention there is provided a simple and inexpensive method for preparation of a Digital Printing Plate that can be imaged on standard digital printing devices.

The method of this invention has the following amongst other steps:

Selection of a right substrate for making the printing plate:

Preferably, the said substrate described has a tensile strength in the range of 400 to 3000 kg/cm$^2$ the preferred range being between 1600 to 2400 kg/cm$^2$.

Preferably the said substrate is suitably heat treated to have shrinkage in the range of 0.2 to 2.0% when exposed to heat at 150 c/10 mm, the preferred range being between 0.4 to 0.8% shrinkage. Preferably the said substrate has a nominal thickness in the range of 50 mic to 250 mic, the preferred thickness range being between 75 mic to 175 mic.

There is no size restriction for the plate for use as a lithographic printing plate hence there is no restrictions in terms of the width or length and therefore plates can be made for any wide format printing up to 4 meters in width. The size of the plates made in accordance with the method of this invention can be any size from A8 to A0.

The plates can be in rolls for imaging on the large format printers of length of up to 100 meters.

In one aspect of the invention the substrate so selected could be a paper or paper laminate or co-extruded substrate of polymeric plastics.

In accordance with another embodiment of the invention the substrate could be selected from synthetic polymeric films typically, PVC/poly laminates.

The method of preparation of the plate in connection with the said embodiment involves treatment of the substrate to alter the surface energy of the substrate to allow better wetting properties and improved bonding of the functional coating.

The effectiveness of the plate in terms of resistance to abrasion during printing is critical to the bonding of the said lithographic coating.

In accordance with one aspect of the invention one mode of preparing the substrate in connection with the said embodiment, a corona charge is used to improve the surface energy.

In another embodiment of subbing the substrate in connection with the said embodiment, an acid treatment of halogenated aliphatic acid is used to etch the surface. Surface area is enhanced in the same method by embedding fused silica during the process.

The said process for the same is critical to process temp used and residence time for etching the surface.

In another mode of subbing in connection with the said embodiment polymeric resins are used to enhance the bonding features, e.g. like polyurethane, polyester resin, polymers of vinyl acetate, co polymers of acrylates and substituted acrylates wherein the substituted alkyl groups could be a methyl, propyl, and butyl etc. copolymers of hydroxyl substituted acrylates and methacrylates and the like.

The lithographic coating in connection with the said embodiment is hydrophilic and is achieved by at least a single ply and preferably two-ply of coating on the subbed substrate.

Typically, a particularly suitable cross linked hydrophilic layer is obtained from a hydrophilic binder cross linked with a suitable cross linking agents, such as formaldehyde, glyoxal, poly functional aziridine, ammonium zirconium carbonate, melamine type cross linker.

The said cross linking is accelerated by use of suitable accelerators, such as ammonium chloride, aluminum sulphate, aluminum chloride, ammonium carbonate, sulphonic acids, alkane sulphonic acids, aromatic sulphonic acids.

These pigments could also comprise of naturally available ores of silicates such as mica, china clay, aluminum silicates, sodium silicates etc.

Preferred pigments used as oxides of silica, titanium, zinc and aluminum and silicate sourced in the form of mineral ores.

The coating of the said layer in two-plies allows a unique morphology of the structure and creates nano channels for the ink to pass The coating in two-plies in connection with the said embodiment allows for unique balancing of the solubility and hydrophillicity of the cross-linked hydrophilic coating.

Unique to this invention is the selection of suitable grades of Silica where in the pore volumes are in the range of 0.2 ml to 1.8 ml/gm.

Unique to this invention is the selection of suitable grades of silica where in the micron size varies in the range 2 micron up to 10 micron.

The selection of the said silica determines the rate of drying and resolution of the image on application.

The hydrophilic binders that may be used are copolymers such as, for e.g. polymers and copolymers of vinyl alcohol, acryl amide, methylol aacryl amilde, methacrylic acid, hydroxy ethyl acrylate, hydroxy methyl methacrylate, substituted maleic anhydride copolymer or a combination thereof, poly vinyl pyrolidone.

Litho coating is suitably modified with cationic surfactants to enhance the image receptivity.

The thickness of the said coating is in accordance with this embodiment would vary from 10 to 30 micron in single ply. The final thickness of the said coating is also achieved by giving a coating with thickness of 5 to 15 micron in first ply and 10 to 25 micron in second ply.

In an alternate embodiment both sides of the substrate are coated to offer printing from both sides.

It is envisaged in the said invention that the coating is daylight processible and the manufacturing operation can be done in daylight. The processing of the said plate can also be done in daylight.

It is feature of the said invention that the uniqueness of the coating used allows the formation of an image through an ink jet printer having standard cartridges mentioned above to accept ink during an offset process.

The unique formulation allows ink to be dried within 5 min depending on the coverage of the same.

It is envisaged in the said invention as disclosed in the embodiment, which allows reproduction of image imaged through conventional screening.

It is further envisaged in the said invention as disclosed in the embodiment, which allows reproduction of imaged through stochastic screening on an ink jet printer. The current capabilities of printers available are up to 2400 dpi.

It is envisaged in the said invention that the uniqueness of the plate allows clean non-image area free of scum and ensures faster start-up. Dot gain is within industry standards.

It is possible to provide four color process capability suitable for application in Packaging, printing and newspaper application for printing of broadsheets.

In accordance with another aspect of the invention the uniqueness of the process further involves fixing of the image formed on the plate for enhanced run length.

Print runs of up to 10,000 impressions have been achieved with suitable fixing.

In context of the above aspect of the invention studies have been done to effect heat post imaging to cure the image.

Fixing can be achieved if the plate is cured at range of 150 c to 200 c for residence time varying between 60 sec to 180 sec. Print run lengths are enhanced.

Fixing can also be achieved with the use of a chemical fixer which when dried effects increased run length.

Typically, the chemical fixer is an emulsion of a hydrophobic resin in suitable sensitizing medium.

The said resin could be a hydrocarbon resin or an acrylate, copolymers of acrylates. The sensitizing medium used could a natural gum, cellulose, carboxy methyl cellulose, starch and the like.

The invention will non be described with reference to the accompanying examples

EXAMPLES

The following non-limiting examples serve to illustrate the invention.

Example 1

Conventional Using Agfa Laser Link Plates

The Laser Link plates manufactured and available in the market from M/s Agfa was used for printing images thereon via an Epson 7600 printer using Epson T5431 Photo black, Epson 480011 Black and Epson T 5437 Light Black inks. The printed images were tested for drying time.

Drying took more than 4 hrs in each of the cases and still the ink when rubbed with the finger, rubbed out.

Dots above 30% bled and loosened out on resolution at screen ruling of 100 lpi. [Lines per inch]

Reverse prints bled and were not legible.

Example 2

Conventional Using Omega EZ

The omega EZ Link plate manufactured and available in the market from M/s Auto type was used for printing images thereon via an Epson 7600 printer using Epson T5431Photo black, Epson T 5437 Light Black and Epson 480011 Black inks. The printed images were tested for Drying Time, and it took more than 4 hrs and still the ink when rubbed with the finger rubbed out. Dot gain was found in dots above 70 percent and loose out on resolution at screen ruling of 120 lpi.

Reverse prints bled and were not legible.

Example 3

Conventional Using NovaDom

The 'Nova Dom' laser-printing plate manufactured by the applicant was used for printing images thereon via an Epson 7600 printer using Epson T5431Photo black, Epson T 5437 Light Black and Epson 480011 Black inks. The printed images were tested for Drying Time took more than 2 hrs and still the ink when rubbed with the finger rubbed out. Dot gain was found in dots above 70 per cent and loose out on resolution at screen ruling of 120 lpi.

Reverse prints bled and were not legible.

Example 4

Example in Accordance with this Invention

A lithographic printing plate in accordance with this invention was prepared in the following manner:

A substrate for making of the printing plate was selected from sheet material of polyester having a tensile strength of 2200 kg/cm$^2$ and thickness of 100 microns in a size of 297 mm wide and 420 mm long. The element was heat stabilized at a temperature of 180° C. for a residence time of 2 minutes in a drying tunnel. The shrunk element was subbed using an acid treatment of the following composition.

Subbing Composition 1

| | |
|---|---|
| water | 97% |
| tri chloro acetic acid | 5% |
| surfactant | 0.05% |

The surface of the element so subbed was treated to heat at 1400° C. for 30 sec and the acid fused to the polyester.

Lithographic Composition 1

Separately, a hydrophilic lithographic coating was formed by reacting 240 grams of partially hydrolyzed alcohol and blended with 60 grams of poly acryl amide solution in a kettle for two hrs at a temp of 80° C.

This blend was used for dispersion of 770 grams of TiO2 and 260 grams of particulate silica of a pore volume of 1.2 ml per gm in a kinetic disperser for two hours.

To this was added with 15 grams of a cross linking agent Glyoxalin, 8 grams of accelerator ammonium sulphate, 8 grams of catalyst, Para toluene sulphonic acid and 5 grams of a ethoxylated nonyl phenol. The coating composition was homogenized in a pearl mill for 6 hours.

An aqueous composition as described above was coated in two plies using a draw down bar on the subbed element.

The coating was done to give a ply in the range of 10 microns, in the first ply and 15 microns in the second ply.

The plate with the coating thereon was cured in an aerofoil dryer for 1 minute were the temperature was maintained at 150° Celsius for each of the Plys.

Several plates were prepared and used for printing images thereon via an Epson 7600 printer and 9600 using Epson T5431Photo black Epson T 5437 Light Black and Epson 480011 Black inks and HP printer DeskJet series like HP 850. HP 880, HP 690, And HP design jet series like HP 2500, HP 3500, HP 430, HP 755, HP 5000, HP 5500 using HP 51645A, HP 51640A and HP 51629A inks.

In respect of each of the images, the ink dried on the respective plates within 5 minutes and a sharp image was formed thereon.

The image in each case was fixed to the plate by curing at 140° Celsius in an oven for 3 minutes.

The results obtained thereon was tested for print run length and printed up to 100 impressions. Coating hardness to abrasion was satisfactory for 100 prints run.

Resolution as determined by Dot Gain at 100 lpi in 2 to 100% range, wherein the dot gain obtained was within industry acceptable tolerances.

Resolution as determined by sharpness of reverse print up to 6 points size, wherein reverse print up to 6 points was clear and sharp.

Example 5

Example in Accordance with this Invention

A lithographic printing plate in accordance with this invention was prepared in the following manner:

A substrate for making of the printing plate was selected from sheet material of polyester having a tensile strength of 2200 kg/cm$^2$. and thickness of 100 microns in a size of 297 mm wide and 420 mm long. The element was heat stabilized at a temperature of 180° C. for a residence time of 2 minutes in a drying tunnel. The shrunk element was subbed using an acid treatment of the following composition.

| | |
|---|---|
| water | 95% |
| tri chloro acetic acid | 4% |
| surfactant (ethoxylated nonyl phenols) | 0.05% |
| silica | 3% |

The surface of the element so subbed was treated to heat at 140° C. for 30 sec and the acid fused to the polyester.

The addition of silica increased the surface area and provided with silanol groups for bonding of subsequent layer with hydrogen bonding.

Lilhographic Composilion 1

Separately, a hydrophilic lithographic coating was formed by reacting 240 grams of partially hydrolyzed alcohol and blended with 60 grams of poly acryl amide solution in a kettle for two hrs at a temp of 80° C.

This blend was used for dispersion of 770 grams of TiO2 and 260 grams of particulate silica of a pore volume of 1,2 ml per gm in a kinetic disperser for two hours.

To this was added with 15 grams of a cross linking agent Glyoxalin, 8 grams of accelerator like ammonium sulphate, 8 grams of catalyst like p toluene sulphonic acid and 5 grams of ethoxylated nonyl phenol surfactant. The coating composition was homogenized in a pearl mill for 6 hours.

An aqueous composition as described above was coated in two plies using a draw down bar on the subbed element.

The coating was done to give a ply of 10 microns in the first ply and 15 microns in the second ply.

The plate with the coating thereon was cured in an aerofoil dryer for 1 minute while the temperature was maintained at 150° C. for each of the ply.

Several plates were prepared and used for printing images thereon via an Epson 7600 printer and 9600 using Epson T5431Photo black Epson T 5437 Light Black and Epson 480011 Black inks and HP printer DeskJet series like HP 850. HP 880, HP 690, And HP design jet series like HP 2500, HP 3500, HP 430, HP 755, HP 5000, HP 5500 using HP 51645A, HP 51640A and HP 51629A inks.

The ink dried on the plate within 5 minutes and a sharp image was formed thereon in each case.

The image was fixed to the plate by curing at 140° C. in an oven for 3 minutes.

The results obtained thereon were tested for print run length of 10,000 impressions. The coating and image remained intact.

Coating hardness to abrasion with stood 10,000 prints run.

The same lithographic plate as described in the above experiment was tested for print length with out fixing the plate and was found to give run lengths of up to 2000 impressions. The coating remained intact.

Resolution as determined by Dot Gain at 100 lpi in 2 to 100% range, wherein the dot gain obtained was within industry acceptable tolerances.

Resolution as determined by sharpness of reverse print up to 6 points size, wherein reverse print up to 6 points was clear and sharp.

The addition and fusion of fumed silica significantly had an impact on the print run length.

Example 6

A lithographic printing plate in accordance with this invention was prepared in the following manner:

The same composition as per example 4 was prepared with the exception that the subbing layer used for bonding of the lithographic composition was made up of

| | |
|---|---|
| Copolymer of polyester resin | 15% |
| 99% hydrolyzed PvOH | 10% |
| Acrylic emulsion of ethyl acrylate butyl acrylate | 10% |
| water | 50% |

The subbing solution so formed was coated on to an element exposed to corona discharge to get a surface dynes level of 45 dynes/cm.

The lithographic composition as described in Example 4 was applied to this element in two-ply and a lithographic printing plate was made in the same way.

Several plates were prepared and used for printing images thereon via an Epson 7600 printer and 9600 using Epson T5431Photo black Epson T 5437 Light Black and Epson 480011 Black inks and HP printer DeskJet series like HP 850. HP 880, HP 690, And HP design jet series like HP 2500, HP 3500, HP 430, HP 755, HP 5000, HP 5500 using HP 51645A, HP 51640A and HP 51629A inks.

The ink dried on the plate within 5 minutes and a sharp image was formed thereon in each case.

The image was fixed to the plate by curing at 140° Celsius in an oven for 3 minutes.

The results obtained thereon were tested for print run length and even after 10,000 impressions, the image remaining intact.

Coating hardness to abrasion with stood 10,000 prints run & the coating remaining intact.

The same lithographic plate as described in the above experiment was tested for print length with out fixing the plate and was found to give run lengths of up to 2000 impressions. The coating remained intact.

Resolution as determined by Dot Gain at 100 lpi in 2 to 100% range, wherein the dot gain obtained was within industry acceptable tolerances.

Resolution as determined by sharpness of reverse print up to 6 points size, wherein reverse print up to 6 points was clear and sharp.

Example 7

A lithographic printing plate in accordance with this invention was prepared in the following manner:

The same composition as per example 6 was prepared with the exception that the particulate silica used was of a lower pore volume of 0.2 mm/gm in the lithographic composition.

Several plates were prepared and used for printing images thereon via an Epson 7600 printer and 9600 using Epson T5431Photo black Epson T 5437 Light Black and Epson 480011 Black inks and HP printer DeskJet series like HP 850. HP 880, HP 690, And HP design jet series like HP 2500, HP 3500, HP 430, HP 755, HP 5000, HP 5500 using HP 51645A, HP 51640A and HP 51629A inks.

The ink dried on the plate after 30 minutes and image was having dot gain and smudged.

The image was fixed to the plate by curing at 140° C. in an oven for 3 minutes.

The results obtained thereon were tested for print run length and even after 10,000 impressions the image remained intact.

Coating hardness to abrasion, with stood 10,000 prints run & the coating remained intact.

Resolution as determined by Dot Gain at 100 lpi in 2 to 100% range, was not acceptable.

This shows that for preparation of a Lithographic plate for use with Ink Jet application, the pore volume of silica used_in Lithographic composition has significant impact on the print resolution.

Example 8

A lithographic printing plate in accordance with this invention was prepared in the following manner:

The same composition as per example 6 was prepared with the exception that the lithographic composition was applied in a single ply on to the subbed support as explained in example 6.

Several plates were prepared and used for printing images thereon via an Epson 7600 printer and 9600 using Epson T5431Photo black Epson T 5437 Light Black and Epson 480011 Black inks and HP printer DeskJet series like HP 850, HP 880, HP 690, And HP design jet series like HP 2500, HP 3500, HP 430, HP 755, HP 5000, HP 5500 using HP 51645A, HP 51640A and HP 51629A inks.

The ink dried on the plate within 5 minutes and a sharp image was formed thereon in each case.

The image was fixed to the plate by curing at 140° Celsius in an oven for 3 minutes.

The results obtained thereon were tested for print run length and even after 10,000 impressions the image remained intact.

Coating hardness to abrasion with stood 10,000 prints run & the coating remained intact.

Resolution as determined by Dot Gain at 100 lpi in 2 to 100% range, wherein the dot gain obtained was higher than those obtained with experiment 6 by, 5% at dots above 70%.

However, resolution of reverse prints of 6-point size was smudged.

This shows that for preparation of a lithographic plate for use with ink jet application, the application of the composition in multiple plies has significant impact on the print resolution.

Example 9

A lithographic printing plate in accordance with this invention was prepared in the following manner:

The subbing layer and method for subbing was the same as in Example 6.

Separately, a hydrophiuic lithographic coating was formed by reacting 240 grams of fully hydrolyzed alcohol and blended with 60 grams of poly acryl amide solution in a kettle for two hrs at a temp of 80° C.

This blend was used for dispersion of 770 grams of TiO2 and 260 grams of particulate silica of a pore volume of 1.2 ml per gm in a kinetic disperser for two hours.

To this was added with 15 grams of a cross linking agent glyoxalin and 5 grams of cationic surfactant. The coating composition was homogenized in a pearl mill for 6 hours.

An aqueous composition as described above was coated in two plies using a pilot coater with direct comma roll applicator on the subbed element. The plate with the coating thereon was cured in an aerofoil dryer for 1 minute while the temperature was maintained at 150° C.

Several plates were prepared and used for printing images thereon via an Epson 7600 printer and 9600 using Epson T5431Photo black Epson T 5437 Light Black and Epson 480011 Black inks and HP printer DeskJet series like HP 850. HP 880, HP 690, And HP design jet series like HP 2500, HP 3500, HP 430, P 755, HP 5000, HP 5500 using HP 51645A, HP 51640A and HP 51629A inks.

The ink dried on the plate within 5 minutes and a sharp image was formed thereon in each case.

The image was fixed to the plate by curing at 140° C. in an oven for 3 minutes.

The results obtained thereon were tested for print run length gave a print length of 1000 impressions.

Coating hardness to abrasion did not withstand more than 1,000 prints run & the coating weakened thereafter.

Resolution as determined by Dot Gain at 100 lpi in 2 to 100% range, wherein the dot gain obtained was within industry acceptable tolerances (quantify??).

Resolution as determined by sharpness of reverse print, where in 6 points size, was found to be sharp and clear.

It is therefore seen that the addition of accelerator and catalyst is critical to impart coating hardness to abrasion and has an impact on the print run length.

Example 10

A lithoaraphic printing plate in accordance with this invention was prepared in the following manner:

The same composition as per example 6 was prepared with the exception that the subbing layer was used for bonding of the lithographic composition was made up of

| | |
|---|---|
| Copolymer of polyester resin | 12-20% |
| 99% hydrolyzed PvOH | 6-12% |
| Acrylic emulsion of ethyl acrylate butyl acrylate | 15-35% |
| water | 67-33% |

The subbing solution so formed was coated on to an element exposed to corona discharge to get a surface dynes level of 45 dynes/cm.

Lithographic Composition

Separately, a hydrophilic lithographic coating was formed by reacting 240 grams of partially hydrolyzed poly vinyl alcohol and blended with 60 grams of poly acryl amide solution in a kettle for two hours at a temp of 80° C.

This blend was used for dispersion of 770 grams of TiO2 and 80 grams of particulate silica of a pore volume of 1.2 ml per gm in a kinetic disperser for two hours.

To this was added with 15 grams of a cross linking agent glyoxalin, 8 grams of accelerator ammonium sulphate, 8 grams of catalyst para toluene sulphonic acid and 5 grams of a cationic surfactant. The coating composition was homogenized in a pearl mill for 6 hours. An aqueous composition as described above was coated in two plies using a draw down bar on a subbed element. The plate with the coating thereon was cured in an aerofoil dryer for 1 minute while the temperature was maintained at 150° C.

The lithographic composition as described above was applied to this element in two-ply and a lithographic printing plate was made in the same way.

Several plates were prepared and used for printing images thereon via an Epson 7600 printer and 9600 using Epson T5431Photo black Epson T 5437 Light Black and Epson 480011 Black inks and HP printer DeskJet series like HP 850. HP 880, HP 690, And HP design jet series like HP 2500, HP 3500, HP 430, HP 755, HP 5000, HP 5500 using HP 51645A, HP 51640A and HP 51629A inks.

The ink dried on the plate within 5 minutes, however the image formed on the plate was of poor resolution.

The image was fixed to the plate by curing at 140° C. in an oven for 3 minutes.

The results obtained thereon was tested for print run length and printed up to 10,000 impressions with the image remaining intact.

Coating hardness to abrasion with stood 10,000 prints run & the coating remained intact.

Resolution as determined by Dot Gain at 100 lpi in 2 to 100% range, wherein the dot gain obtained was very high in the shadows and not within industry acceptable tolerances.

Resolution as determined by sharpness of reverse print up to 6 points size, wherein reverse print up to 6 points was not clear and smudged.

It is therefore seen that the ratio of silica used is critical to the final resolution of the image formed and has an impact on the print resolution.

Example 11

A lithographic printing plate in accordance with this invention was prepared in the following manner:

The same composition as per example 6 was prepared with the exception that the subbing layer used for bonding of the lithographic composition was made up of

| | |
|---|---|
| Copolymer of polyester resin | 12-20% |
| 99% hydrolyzed PvOH | 6-12% |
| Acrylic emulsion of ethyl acrylate butyl acrylate | 15-35% |
| water | 67-33% |

The subbing solution so formed was coated on to an element exposed to corona discharge to get a surface dynes level of 45 dynes/cm.

Lithographic Composition

Separately, a hydrophilic lithographic coating was formed by reacting 240 grams of partially hydrolyzed poly vinyl alcohol and blended with 60 grams of poly acryl amide solution in a kettle for two hours at a temp of 80° C.

This blend was used for dispersion of 680 grams of micronised china clay and 150 grams of particulate silica of a pore volume of 1.2 ml per gm in a kinetic disperser for eight hours.

To this was added with 15 grams of a cross linking agent glyoxalin, 8 grams of accelerator ammonium sulphate, 8 grams of catalyst para toluene sulphonic acid and 5 grams of a cationic surfactant. The coating composition was homogenized in a pearl mill for 6 hours. An aqueous composition as described above was coated in two plies using a draw down bar on a subbed element. The plate with the coating thereon was cured in an aerofoil dryer for 1 minute while the temperature was maintained at 150° C.

The Lithographic composition as described above was applied to this element in two-ply and a lithographic printing plate was made in the same way.

Several plates were prepared and used for printing images thereon via an Epson 7600 printer and 9600 using Epson T5431Photo black Epson T 5437 Light Black and Epson 480011 Black inks and HP printer DeskJet series like HP 850. HP 880, HP 690, And HP design jet series like HP 2500, HP 3500, HP 430, HP 755, 1H 5000, HP 5500 using HP 51645A. HP 51640A and HP 51629A inks.

The ink dried on the plate within 5 minutes, however the image formed on the plate was of poor resolution.

The image was fixed to the plate by curing at 140° C. in an oven for 3 minutes.

The results obtained thereon was tested for print run length and printed up to 10,000 impressions with the image remaining intact.

Coating hardness to abrasion with stood 10,000 prints run & the coating remained intact.

Resolution as determined by Dot Gain at 100 lpi in 2 to 100% range, wherein the dot gain obtained was within industry acceptable tolerances.

Resolution as determined by sharpness of reverse print up to 6 points size, wherein reverse print up to 6 points was clear It is therefore seen that as a pigment micronised china clay could also be used with similar print performance.

Example 12

The same composition was prepared as that described in example 6 with the exception that the coated lithographic composition contained 8 grams of methane sulphonic acid.

An aqueous composition as described above was coated in two plies using a draw down bar on a subbed element.

The coating was done to give a ply of 10 microns in the first ply and 15 microns in the second ply.

Each ply of the plate with the coating thereon was cured in an aerofoil dryer for 1 minute were the temperature was maintained at 150° C. for each of the ply.

Several plates were prepared and used for printing images thereon via an Epson 7600 printer and 9600 using Epson T5431Photo black Epson T 5437 Light Black and Epson 480011 Black inks and HP printer DeskJet series like HP 850. HP 880, HP 690, And HP design jet series like HP 2500, HP 3500, HP 430, H 755, HP 5000, HP 5500 using HP 51645A, HP 51640A and HP 51629A inks.

The results obtained were similar to example 6.

Example 13

The same composition was prepared as that described in example 6 with the exception that the coated lithographic composition also contained 5 grams of an UV absorber Uvitex OB An aqueous composition as described above was coated in two plies using a draw down bar on a subbed element.

The coating was done to give 10 microns in the first ply and 15 microns in the second ply.

The plate with the coating thereon was cured in an aerofoil dryer for 1 minute while the temperature was maintained at 150° C. for each of the ply.

When tested for print images as in the above examples the contrast was found to be superior to the non-UV absorber containing plates. The aesthetics of the image therefore improved.

Example 14

The same composition was prepared as that described in example 5 with the exception that the coated hydrophilic composition would also contain 60 grams of acid treated aluminum oxide and 200 grams of precipitated silica of pore value 0.2 ml/gm respectively.

An aqueous composition as described above was coated in two plies using a draw down bar on a subbed element.

The coating was done as in example 5.

The plate with the coating thereon was cured in an aerofoil dryer for 1 minute were while the temperature was maintained at 150° C. for each of the ply.

When tested for images as in the above example the print run length was below 2000 impressions and the resolution above 70% dots had a dot gain of 8%. This shows that aluminum oxide or precipitated silica not of the discovered pore value did not give the desired results anticipated in accordance with this invention.

Example 15

The same composition was prepared as that described in example 5 with the exception that the hydrophilic binder blend used for the lithographic composition contained 60 grams of hydroxyl substituted methyl methacrylate co polymer An aqueous composition as described above was coated in two plies using a draw down bar on a subbed element.

The coating and drying was done as in the above examples.

Several plates were prepared and used for printing images thereon via an Epson 7600 printer and 9600 using Epson T5431Photo black Epson T 5437 Light Black and Epson 480011 Black inks and HP printer DeskJet series like HP 850. HP 880, HP 690, And HP design jet series like HP 2500, HP 3500, HP 430, HP 755, HP 5000, HP 5500 using HP 51645A, HP 51640A and HP 51629A inks.

The results obtained were similar to example 6.

Example 16

The same composition was prepared as that described in example 5 with the exception that the coated lithographic composition contained 15 grams of methylated urea as a cross linker in place of glyoxalin.

Coating and drying was done in the same manner.

Several plates were prepared and used for printing images thereon via an Epson 7600 printer and 9600 using Epson T5431Photo black Epson T 5437 Light Black and Epson 480011 Black inks and HP printer DeskJet series like HP 850. HP 880, HP 690, And HP design jet series like HP 2500, HP 3500, HP 430, HP 755, HP 5000, HP 5500 using HP 51645A, HP 51640A and HP 51629A inks.

The results obtained were similar to example 6.

Example 17

The same composition was prepared as that described in example 5 with the exception that the coated hydrophilic composition would contain 240 gms of partially hydrolyzed poly vinyl alcohol as hydrophilic binder in place of fully hydrolyzed poly vinyl alcohol.

An aqueous composition as described above was coated in two plies using a draw down bar on a subbed element.

Coating and drying was done as in the above examples.

Several plates were prepared and used for printing images thereon via an Epson 7600 printer and 9600 using Epson T5431Photo black Epson T 5437 Light Black and Epson 480011 Black inks and HP printer DeskJet series like HP 850. HP 880, HP 690, And HP design jet series like HP 2500, HP 3500, HP 430, HP 755, HP 5000, HP 5500 using HP 51645A, HP 51640A and HP 51629A inks.

The results obtained were similar to example 6.

Example 18

A lithographic printing plate in accordance with this invention was prepared in the following manner:

The same composition as per example 6 was prepared with the exception that the subbing layer used for bonding of the lithographic composition was made up of Copolymer of PVOH, PVAc, PVCl (Trade Name VMCH) 12-20%

The subbing solution so formed was coated on to an element exposed to corona discharge to get a surface dynes level of 45 dynes/cm.

An Aqueous lithographic composition similar to Ex 6 was coated and dried as described in example 6.

Several plates were prepared and used for printing images thereon via an Epson 7600 printer and 9600 using Epson T5431Photo black Epson T 5437 Light Black and Epson 480011 Black inks and HP printer DeskJet series like HP 850. HP 880, HP 690, And HP design jet series like HP 2500, HP 3500, HP 430, HP 755, HP 5000, HP 5500 using HP 51645A, HP 51640A and HP 51629A inks.

The ink dried on the plate within 5 minutes, however the image formed on the plate was of poor resolution.

The image was fixed to the plate by curing at 1400° C. in an oven for 3 minutes.

The results obtained thereon was tested for print run length and printed up to 10,000 impressions with the image remaining intact.

Coating hardness to abrasion with stood 10,000 prints run & the coating remained intact.

Resolution as determined by Dot Gain at 100 lpi in 2 to 100% range, wherein the dot gain obtained was within industry acceptable tolerances.

Resolution as determined by sharpness of reverse print up to 6 points size, wherein reverse print up to 6 points was clear Example 19

A lithographic printing plate was made as per Example 6 except that the element used for coating was a high wet strength paper of 120 gsm of cob value 20.

The paper was coated with a co polymer of Polystyrene to improve the wet strength. On this was coated the lithographic composition as per example 6 in two ply and dried as described in Ex 6.

Several plates were prepared and used for printing images thereon via an Epson 7600 printer and 9600 using Epson T5431Photo black Epson T 5437 Light Black and Epson 480011 Black inks and HP printer DeskJet series like HP 850. HP 880, HP 690, And HP design jet series like HP 2500, HP 3500, HP 430, HP 755, HP 5000, HP 5500 using HP 51645A, HP51640A and HP 51629A inks.

The ink dried on the plate within 5 minutes, however the image formed on the plate was of poor resolution.

The image was fixed to the plate by curing at 140° C. in an oven for 3 minutes.

The results obtained thereon was tested for print run length and printed up to 10,000 impressions with the image retraining intact.

Coating hardness to abrasion with stood 10,000 prints run & the coating remained intact.

Resolution as determined by Dot Gain at 100 lpi in 2 to 100% range, wherein the dot gain obtained was within industry acceptable tolerances.

Resolution as determined by sharpness of reverse print up to 6 points size, wherein reverse print up to 6 points was clear The hydrophilic coatings formulated can be coated on a coating machine using any one of the coating methods, selected from Meir bar wire coatings
Comma Doctor
Three roll reverse
Indirect comma doctor
Gravure coating
Indirect gravure with chamber doctor.

The drying and curing of the composition is critical to get a uniform stress free layer with uniform layers.

The examples tried above were used for ink jet imaging to get a litho graphic printing plate using an Epson 7600 printer using Epson T5431 Photo black, Epson T480011 Black, Epson T 5437 Light Black, Epson T 5432 Cyan, Epson T483011 Cyan, Epson T 5435 Light Cyan, Epson T 5436 Magenta, Epson 484011 Light Magenta, Epson T 481011 Yellow, Epson T 5434 Yellow and likes and also on Hewlett Packard Inks like HP 51645A, HP 51640A, HP 51629A on HP large format printers and business graphic models.

While considerable emphasis has been placed herein on the structures and structural interrelationships between the component parts of the preferred embodiments, it will be appreciated that many embodiments can be made and that many changes can be made in the preferred embodiments without departing from the principals of the invention. These and other changes in the preferred embodiment as well as other embodiments of the invention will be apparent to those skilled in the art from the disclosure herein, whereby it is to be distinctly understood that the foregoing descriptive matter is to be interpreted merely as illustrative of the invention and not as a limitation.

The invention claimed is:

1. A method of preparing a lithographic printing plate suitable for use with inkjet printers as image forming devices, said inkjet printers using a pigment based ink, said method comprising the steps of:

a) selecting a substrate which is a synthetic polymeric sheet having a tensile strength of 400 to 3000 kg/cm$^2$ and a thickness of 75 to 250 microns;

b) shrinking said substrate to have shrinkage in the range of 0.2 to 2.0% by exposing the substrate to temperatures ranging from 140 to 180° C. for 8 to 12 minutes;

c) treating the surface to alter the surface energy of the substrate, and d) forming at least one layer of a hydrophilic lithographic coating obtained by reacting a hydrophilic binder, a cross linking agent, a catalyst, an accelerator, at least one pigment, at least one nonionic surfactant and particulate silica having particle size between 1 to 5 microns and pore volume between 0.2 to 1.8 ml/gm, wherein the ratio of catalyst to accelerator is 1:1, ratio of catalyst to cross linking agent is 8:15, ratio of catalyst to hydrophilic binder is 8:300, ratio of catalyst to pigment is 8:770, ratio of catalyst to surfactant is 8:5 and ratio of catalyst to particulate silica is 8:260.

2. The method of preparation of a lithographic printing plate of claim 1, in which the tensile strength of the sheet is betweeni 1600 to 2400 kg/cm$^2$.

3. The metbod of preparation of a lithographic printing plate of claim 1, in which the size of the sheet is between A8 to A0.

4. The method of preparation of a lithographic printing plate of claim 1, wherein the substrate is polymeric plastic.

5. The method of preparation of a lithographic printing plate of claim 1, in which treating the surface of the substrate is done by corona charge.

6. The method of preparation of a lithographic printing plate of claim 1, wherein treating the surface of the substrate is done by acid treatment with halogenated aliphatic acid.

7. The method of preparation of a lithographic printing plate of claim 1, wherein treating of the surface of the substrate is done by chlorinated phenols.

8. The method of preparation of a lithographic printing plate of claim 1, wherein treating of the surface of the substrate is done by embedding fused silica in the substrate.

9. The method of preparation of a lithographic printing plate of claim 1, wherein treating of the surface of the substrate is done by applying on the substrate a polymeric resin selected from the group consisting of polyurethane, polyester resin, polymers of vinyl acetate, copolymers of acrylates and alkyl substituted acrylates wherein the substituted alkyl is selected from the group consisting of methyl, propyl and butyl and a copolymer of hydroxy substituted acrylates and methacrylates.

10. The method of preparation of a lithographic printing plate of claim 1, wherein the hydrophilic binder is at least one binder selected from the group consisting of fully hydrolyzed polyvinyl alcohol, partially hydrolyzed polyvinyl alcohol, polymer of acryl amide, polymer of methyol acryl amide, copolymer of hydroxy ethyl acrylate and methyl methacrylate, copolymer of hydroxy methyl methacrylates with acrylic acid, vinyl methyl ether and maleic anhydride adduct, and pyrolidone.

11. The method of preparation of a lithographic printing plate of claim 1, wherein the cross linking agent is at least one member selected from the group consisting dialdehydes, methylol urea, polyfunctional aziridine, ammonium zirconium carbonate, and melamine type cross linker.

12. The method of preparation of a lithographic printing plate of claim 1, wherein the accelerator is at least one member selected from the group consisting of ammoniurn chloride, sulfate, alum, aluminum chloride, and aluminum sulfate.

13. The method of preparation of a lithographic printing plate of claim 1, wherein the pigment is at least one member selected from the group consisting of oxides of zinc, titanium, selenium and other transition metal oxides and mineral ores of silicates.

14. The method of preparation of a lithographic printing plate of claim 1, wherein the catalyst is at least one member selected from the group consisting of aromatic and aliphatic sulfonic acids.

15. The method of preparation of a lithographic printing plate of claim 1, wherein the coating is applied on the substrate by gravure method.

16. The method of preparation of a lithographic printing plate of claim 1, wherein the coating is applied on the substrate by Meir bar wire coatings.

17. The method of preparation of a lithographic printing plate of claim 1, wherein the coating is applied on the substrate by Comma Doctor.

18. The method of preparation of a lithographic printing plate of claim 1, wherein the coating is applied on the substrate by three roll reverse method.

19. The method of preparation of a lithographic printing plate of claim 1, wherein the coating is applied on the substrate by indirect Comma Doctor.

20. The method of preparation of a lithographic printing plate of claim 1, wherein the coating is applied on the substrate by indirect gravure with a Chamber Doctor.

21. The method of preparation of a lithographic printing plate of claim 1, wherein the substrate with the coating applied is cured by heat.

* * * * *